United States Patent [19]

Carlson

[11] Patent Number: 4,818,140

[45] Date of Patent: Apr. 4, 1989

[54] SCREED EXTENDER WITH BERM-FORMING SCREED

[76] Inventor: James O. Carlson, 1022 Arleo La., Tacoma, Wash. 98466

[21] Appl. No.: 146,849

[22] Filed: Jan. 22, 1988

[51] Int. Cl.[4] ..... E01C 19/22

[52] U.S. Cl. ..... 404/118; 404/114; 404/96; 404/104; 425/456

[58] Field of Search ..... 404/96, 98, 104–106, 404/114, 118–120; 425/456, 458

[56] References Cited

U.S. PATENT DOCUMENTS

| | | | |
|---|---|---|---|
| 1,782,707 | 11/1930 | Bayley | 404/96 |
| 3,680,451 | 8/1972 | Birtchet | 404/104 |
| 3,957,384 | 5/1976 | Lamb et al. | 404/118 |
| 4,364,690 | 12/1982 | Bruns | 404/118 |
| 4,379,653 | 4/1983 | Brown | 404/104 X |
| 4,493,585 | 1/1985 | Axer | 404/118 X |
| 4,702,642 | 10/1987 | Musil | 404/118 |

*Primary Examiner*—Jerome W. Massie
*Assistant Examiner*—John F. Letchford
*Attorney, Agent, or Firm*—Seed and Berry

[57] ABSTRACT

A screed assembly has two screed sections hingedly connected together at meeting beveled ends. The hing between the screed sections maintains a hinge axis at the soles thereof as one of the screed sections is swung upwardly to define a sloped face for a berm alongside a paving mat as a paving machine with the screed assembly progresses to form the berm and paving mat simultaneously.

11 Claims, 4 Drawing Sheets

FIG. 7
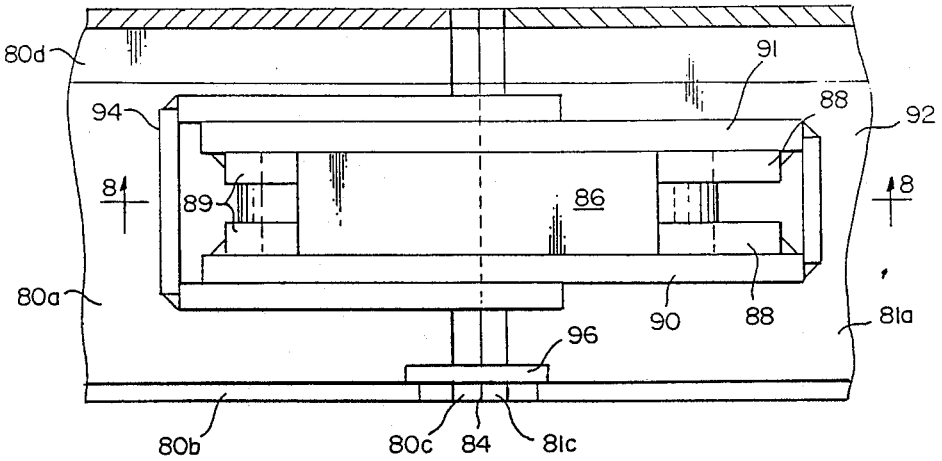
FIG. 8
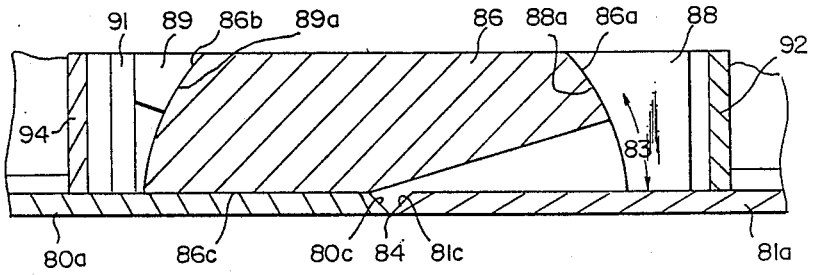
FIG. 9
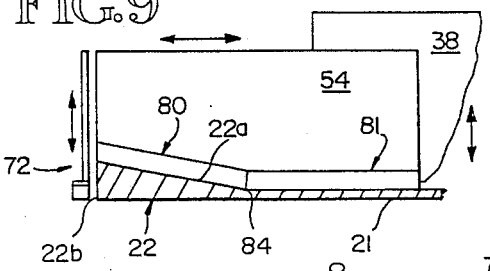
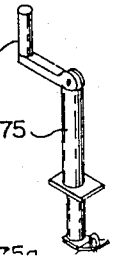
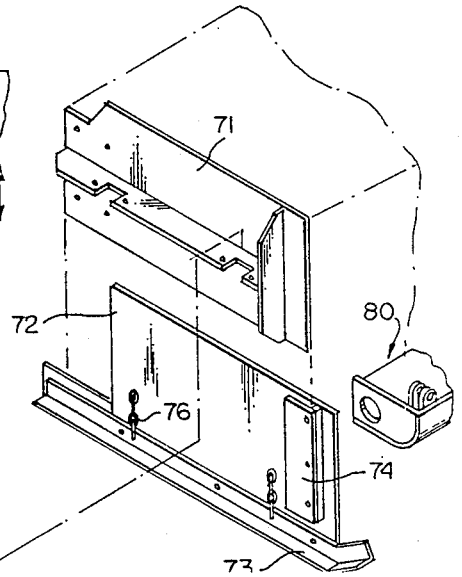
FIG. 10

SCREED EXTENDER WITH BERM-FORMING SCREED

TECHNICAL FIELD

The present invention relates to asphalt pavers of the floating screed type equipped with an adjustable screed extender which projects beyond the end of the main screed of the paver when in use.

BACKGROUND ART

Typically, floating screed pavers comprise a self-propelled paving vehicle having a hopper at its forward end for receiving paving material from a dump truck pushed forwardly along the roadbed by the paver so that the truck progressively dumps its load of paving material into the hopper. A conveyor system on the paver transfers the paving material from the hpper rearwardly for discharge onto the roadbed in front of transversely arranged screw augers which spread the material laterally in front of a main screed. This screed is commonly operated as a so-called "floating screed" by being connected to the paving vehicle by pivoted tow arms, and functions to compress and level the paving material distributed by the augers to give a smooth finished road surface. The height of the tow points at each side of the paver and the attack angle of the screed may be varied to control the depth and surface of the paving mat.

For many paving activities, there is a need to widen the effective width of the screed, and this has been accomplished by providing the main screed with one or two adjustable extensions, as disclosed and discussed, for example, in Brown, U.S. Pat. No. 4,379,653, or providing a self-contoured screed extender as previously manufactured by Carlson Paving Products, Inc. Tacoma, Wash. ("the prior Carlson screed extender").

DISCLOSURE OF THE INVENTION

In the use of asphalt pavers, there has commonly been a need not only to widen the screed width, but also to form a sloped berm or curb at the shoulder of the road. The present invention provides an improved version of the prior Carlson screed extender, making it possible to easily form sloped berms of controlled slop during the normal paving operation.

The prior Carlson screed extender was mounted on the moldboard of the paver and provided an extension screed which was vertically and longitudinally adjustable relative to the main screed. It was also possible to tilt the extension screed downwardly at its outer end relative to the main screed. By the present invention, the extension screed is divided into inner and outer screed sections which are hinged together so that the outer screed section can swing upwardly relative to the inner screed section. A jackscrew or other suitable elevating means is pivotally connected at its lower end adjacent the outer end of the outer screed section and has its upper end pivotally connected to a slide body. The latter has a floating gate mounted on its outer end and has the inner screed section mounted on its lower end. The slide body is mounted on a slide rail carried by the moldboard for the main screed of the paver, and the slide rail is vertically adjustable relative to the moldboard.

BRIEF DESCRIPTION OF THE DRAWINGS

In the drawings:

FIG. 7 is a top plan view of the hinge mounted on the screed sections, which are shown without cover plates;

FIG. 8 is a longitudinal vertical sectional view of thq hinge taken as indicated by line 8—8 of FIG. 7;

FIG. 9 is a schematic elevational view showing the screed sections of the screed extender in berm-forming position; and FIG. 10 is an exploded view of the foating end gate assembly.

BEST MODE FOR CARRYING OUT THE INVENTION

Figure 1:
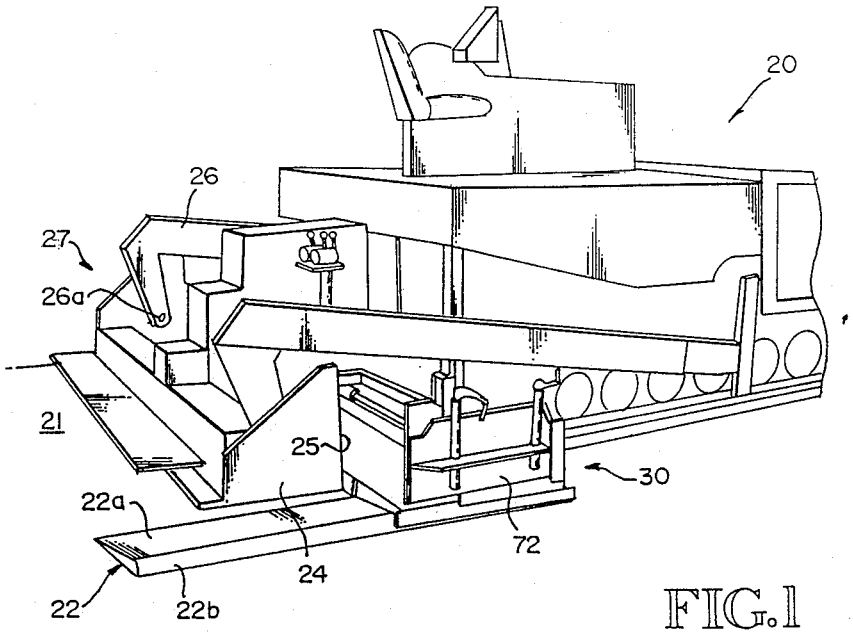
FIG. 1 is a perspective view of a paver equipped with a screed extender embodying the present invention.
Figure 2:
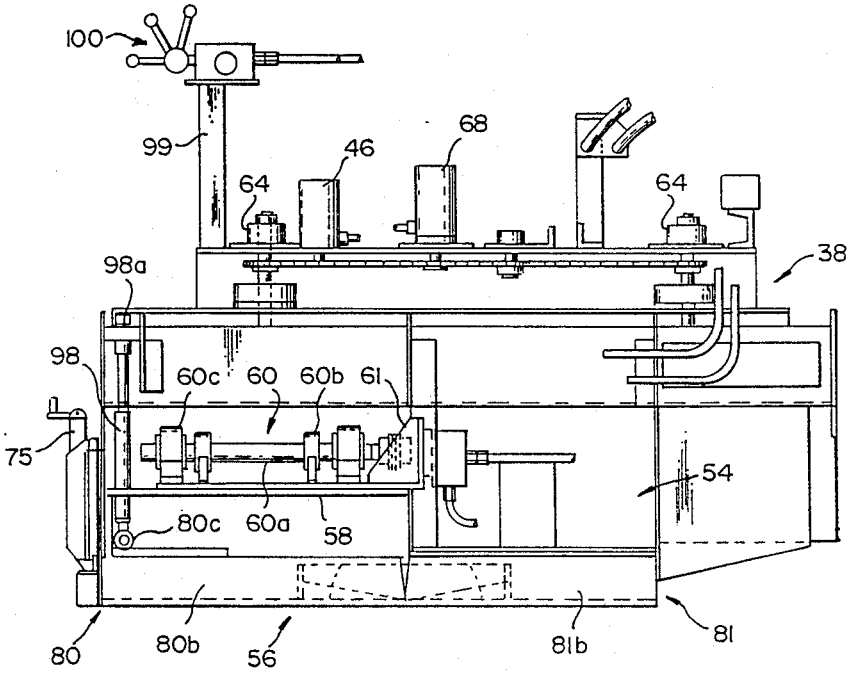
FIG. 2 is a front elevational view of the screed extender with the front cover removed.

Referring to FIG. 1, a conventional asphalt paving machine 20 equipped with the present invention is illustrated operating to spread and grade an asphalt road mix on a road surface to form a paving mat 21 with a shoulder berm 22 to the right having a sloped upper face 22*a* and a generally vertical outer face 22*b*. The machine 20 has a rear main screed 24 extending rearwardly from an upright moldboard 25. Elevation of the screed is determined by adjustment of a pair of tow arms 26 pivotally connected at 26*a* to a supporting frame 27 for the moldboard and screed. Asphalt mix carried by the machine 20 is spread laterally in front of the moldboard 25 by augers (not shown) which are spaced forwardly of the moldboard 25 sufficiently to permit a screed extender 30 to be mounted between the screed 24 and the augers. In some instances, the length of the tow arms is extended to make room for a screed extender.

Figure 4:
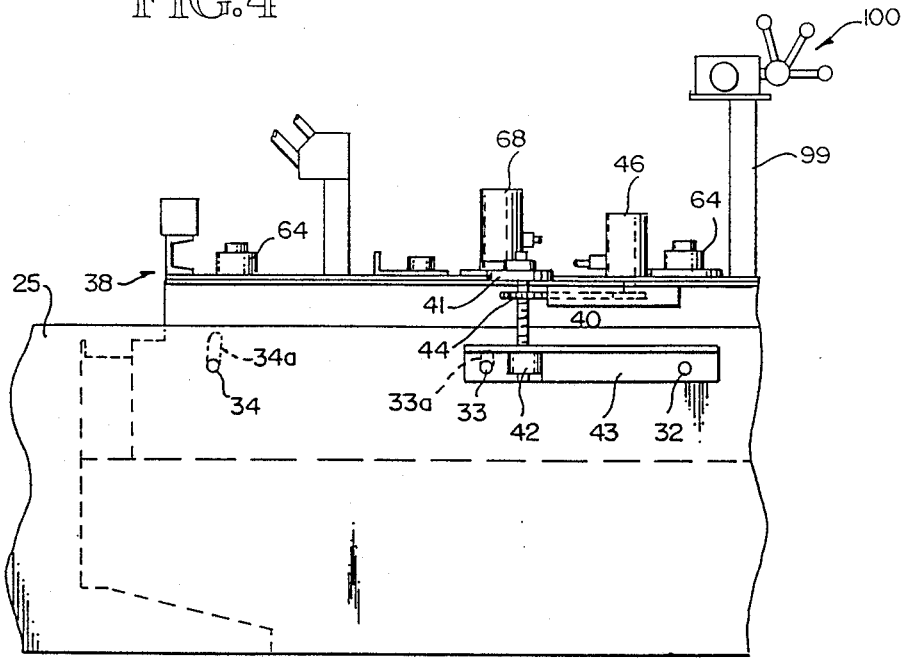
FIG. 4 is a rear elevational view of the screed extender.
Figure 5:
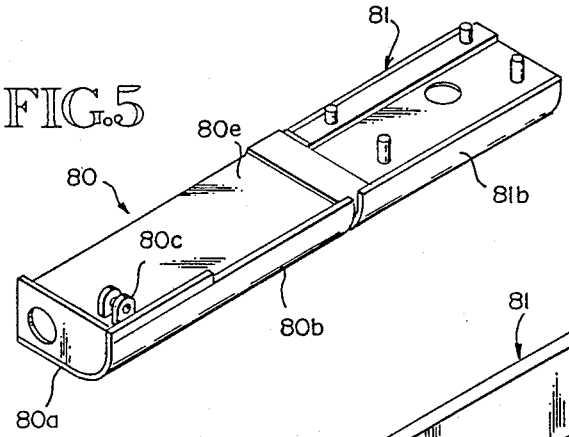
FIG. 5 is a perspective view of the hinged screed sections of the extender.

The preferred screed extenders for application of the present invention are the prior Carlson screed extenders. These extenders are mounted on the front of the main moldboard 25 of the paving machine by way of three bolts 32, 33 and 34 which pass through a rear mounting plate 36, the moldboard 25, and a front mounting assembly 38. As indicated in FIG. 4, the bolts 33–34 preferably pass through arcuate slots 33*a*–34*a* formed in the moldboard so that the rear mounting plate 36 and front mounting assembly 38 can be swung upwardly for slope adjustment relative to the moldboard 25 with the bolt 32 as a pivot by action of a jackscrew 40. The latter is mounted for turning movement on a flange 41 at the upper end of the moldboard 25, and operates through a pivoted nut unit 42 at its lower end. The nut unit 42 is mounted at the underside of an angle bracket 43 welded on the back of the rear mounting plate 36. Turning of the jackscrew 40 is accomplished by a chain and sprocket drive 44 from a hydraulic slope-adjusting motor 46.

Figure 3:
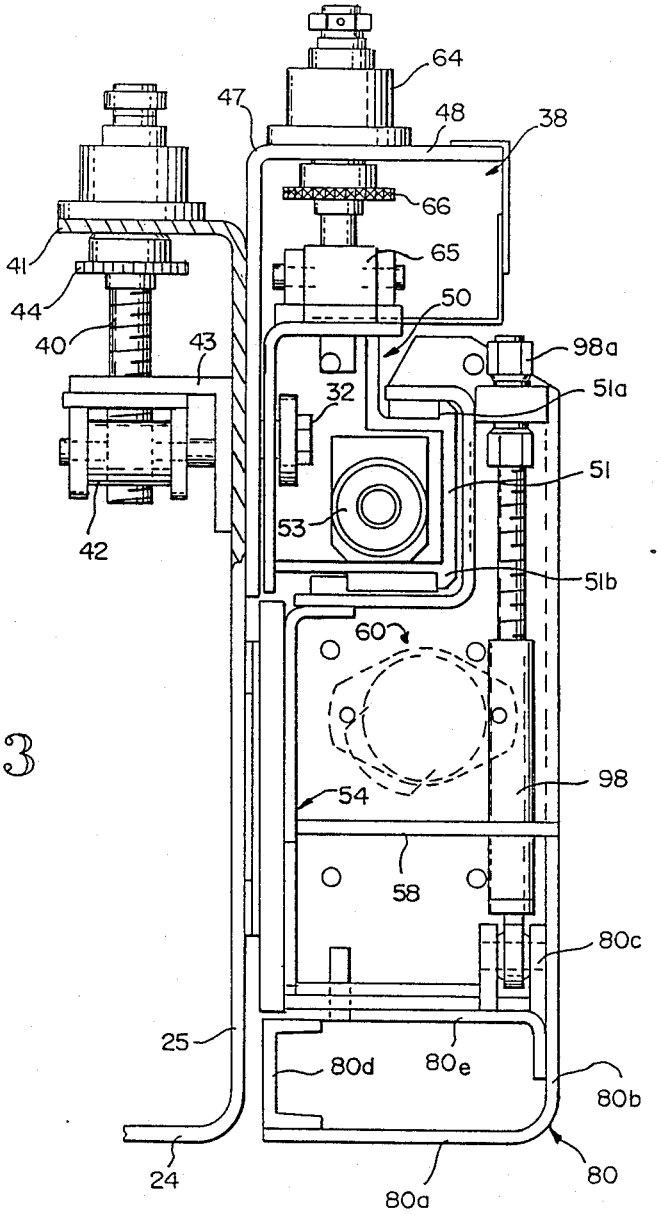
FIG. 3 is an outer end view of the screed extender without end plates.

Referring to FIG. 3, the front mounting assembly 38 has a front mounting plate 47 with an upper shelf 48 spaced above a slide rail unit 50 which is vertically adjustable at the front of the mounting plate 47. The rail unit 50 is fabricated as a tubular structure which is stepped at the front to provide a forwardly jutting rail 51 having upper and lower retaining lips 51*a*, 51*b* at the front. A front slide member 52 complements the rail 51, and suitable wear plates are provided at the top, front and bottom of the rail 51. Housed in the rail unit 50 is a hydraulic cylinder 53 having its piston rod bearing against the outer end wall of the slide member 52 for extending the slide member relative to the rail unit 50.

The slide member 52 rigidly carries a depending slide frame 54 at the bottom of which is mounted an articulated extension screed assembly 56 to which the present invention is directed. Intermediate the slide member 52 and the extension screed assembly, the slide frame 54 presents a shelf 58 in which a vibration unit 60 is mounted. This unit 60 may comprise a shaft 60*a* carrying a pair of eccentrics 60*b* and journaled in bearing blocks 60*c*. The shaft 60*a* may be driven by a hydraulic motor 61.

Vertical adjustment of the rail unit 50 to thereby vertically adjust the extension screed assembly 56 is accomplished by a pair of parallel jackscrews 62, 63. The latter are suspended from top bearing units 64 and act through nuts 65 pivotally mounted on the top of the rail unit 50 as shown in FIG. 3. A chain 66 driven by a sprocket on a hydraulic motor 68 drives sprockets on the jackscrews 62, 63 to turn them in unison in the selected direction of rotation. The chain 66, after looping around te motor sprocket, loops oppositely around an idler 70. From the motor sprocket the chain 66 loops around the sprocket for jackscrew 62, and from the idler loop it extends to a loop around the sprocket for jackscrew 63 to connect at the back with the loop for the jackscrew 62.

Referring to FIG. 10, at its outer end the slide member 52 has a support unit 71 for a floating end gate 72 having a bottom runner 73. The end gate 72 slides vertically behind the support unit 71 and has a front slide 74 receiving the foward end portion of the support unit 71. Vertical adjustment of the floating end gate 72 is accomplished by a pair of screw jacks 75 mounted on an outer flange 76. the jacks 75 have forks 75*a* at their lower ends which selectively interfit with the links of short lengths of chain 76 mounted on the end gate 72. Fine adjustment of the maximum drop of the end gate 72 is accomplished by manually turning the handles 75*b* of the screw jacks 75. Broad adjustment is accomplished by first selecting the appropriate link of chains 76 to interfit with the forks 75*a* on the screw jacks.

Figure 6:
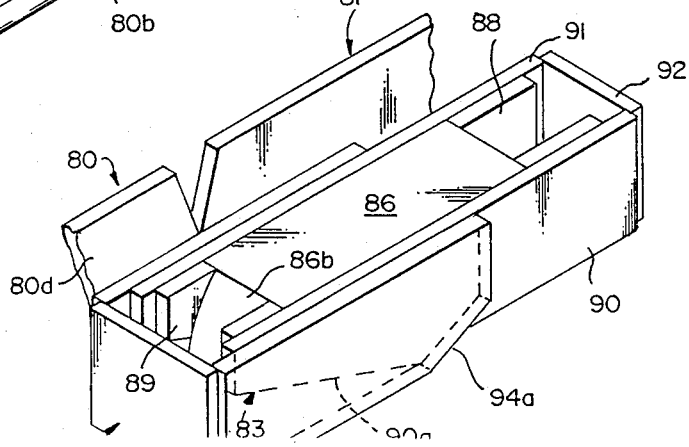
FIG. 6 is a perspective view of the hinge for the screed sections, with part of the latter shown.

Continuing to the extension screed assembly 56, it will be noted that it comprises an outer screed section 80 which is pivotally mounted for upward swinging movement on the outer end of an inner screed section 81 which in turn is fixed to the lower end of the slide frame 54. The screed sections 80, 81 are suitably reinforced at the back, top and ends, and have bottom screed portions 80*a*, 81*a* joined at a rounded bend to front moldboard portions 80*b*, 81*b*. Attention is directed to FIGS. 6–8, showing the hinge unit for swinging the outer screed section 80 on the inner screed section 81. To permit such swinging, the meeting ends of the screed sections 80, 81 are tapered to provide a swing angle 83 between beveled meeting edges 80*c*, 81*c* on the screed portions 80*a*, 81*a* and complementing sloped opposed edges 80*d*, 81*d* on the moldboard portions 80*b*, 81*b*. The beveled edges 80*c*, 81*c* meet at an apex 84 at the level of the sole faces of screed portions 80*a*, 81*a* when the screed sections 80, 81 are aligned in coplanar relation. This apex 84 is the center of curvature for the curved convex end faces 86*a*, 86*b* of a center hinge block 86 which is fixed along a bottom face 86*c* to the top face of screed portion 80*a*, for example. The bottom face 86*c* extends from the end face 86*b* to the beveled inner edge 80*c*, and then forms a dihedral angle with a sloped face 86*d* which slopes upwardly to the other curved end face 86*a*. As can be seen in FIG. 8, this dihedral angle and the swing angle 83 are supplementary angles.

The curved end faces 86*a*, 86*b* of the center hinge block 86 are complemented by curved concave edge faces 88*a*, 89*a*, respectively, on two pairs of outer hinge plates 88, 89 provided on the inner opposed faces of a pair of side plates 90, 91. These side plates are preferably interconnected by an end plate 92 and straddle the center hinge block 86. The end plate 92 and adjoining halves of the side plates 90, 91 are fixed to the upper face of the screed portion 80*a* as by welding. At the upper edge of beveled edge 80*c*, the lower edges of the side plates 90, 91 are sloped upwardly, as indicated by 90*a*, to the extent of the swing angle 83. Preferably, the hinge assembly 82 is also provided with an outer reinforcing U-frame 92 which straddles the side plates 90, 91 and is fixed to the upper face of the screed portion 81. The U-frame 94 extends over the hinge axis 84 and has tapered bottom edge portions 94*a* parallel to the sloped face 86*d* of the center block 86. Preferably, the space between the ends of the moldboard portions of the extender screed sections are covered by a cover plate 96 fixed, for example, to moldboard portion 81 and tapered on its underside like the tapers 94*a* on the underside of the U-frame 94.

Adjacent its front outer corner, the outer screed section 80 presents a pair of upper ears 80*c* to pivotally connect the outer screed section to the lower end of a lifting screw jack 98 which is pivotally connected at its upper end to the slide frame 52. At its upper end, the jack 98 has a handle or suitable fitting 98*a* to receive a wrench for operating the jackscrew 98 to selectively swing the outer screed section 80 up and down about the swing axis 84. If desired, the jack 98 may be provided with a power unit or be replaced by a double-acting hydraulic cylinder.

A control stand 99 is mounted on the front mounting assembly 38 to hold a bank of hydraulic control valves 100 for controlling the hydraulic motor 46 for downward slope adjustment, hydraulic motors 68 for elevation adjustment, the hydraulic motor 61 of the vibration unit 60, and hydraulic cylinder 53 for screed extension.

Referring to FIG. 9, in operation of the apparatus to form a sloped berm 22 at the side of a road mat 21, the slide frame 54 is extended beyond the main screed 24 of the paving machine the required distance to the berm location. Normally, the extension should be sufficient to position the hinge axis 84 at least as far out laterally of the paving machine as the corresponding end of the main screed 24. The elevation of the inner screed section 81 is set at the proper height relative to the main screed 24, either before or after extension. Then the slope angle of the berm face 22*a* is set by operation of the jack 98 and the desired height of the floating end gate 72 is set. The paver 20 is then ready for operation. As the paver progresses, the road surfacing material is fed laterally in front of the main screed 24 and the screed sections 80, 81 of the extender until the material reaches the end gate 72. As the material is then spread evenly beyond the main screed by the screed sections 80, 81, it is properly compacted by operation of the vibration unit 60. Because the swing axis 84 is always located at the sole faces of the screed sections 80, 81 regardless of the berm slope angle selected, the road surfacing material is prevented from lodging between the meeting ends of the screed sections and interfering with adjustment of the hinge angle 83. The cover plate 96 assists in this regard.

From the foregoing it will be appreciated that, although specific embodiments of the invention have been described herein for purposes of illustration, various modifications may be made without deviating from the spirit and scope of the invention. Accordingly, the invention is not limited except as by the appended claims.

I claim:

1. A screed extension unit comprising:

a slide rail unit adapted to be mounted on a paving machine with a primary screed and having an inner end and an outer end;

a slide body unit slidably mounted on the slide rail unit for selectively extending outwardly beyond the outer end of the slide rail unit and beyond one end of said primary screed;

an extension screed having an inner screed section mounted at the bottom of said slide body unit and having an outer screed section pivotally mounted at the outer end of the inner screed section for vertical swinging movement in an arc between a lower position aligned with said inner screed section and a raised position sloping upwardly away from said inner screed section, said screed sections each having a respective bottom screed face therealong, with the inner end of the bottom screed face of the outer screed section being substantially in contact with the outer end of the bottom screed face of the inner screed section in all positions of said outer screed section in said arc; and slope adjusting means extending between said outer screed section and said slide body unit for selectively swinging said outer screed section in said arc.

2. A screed extension unit according to claim 1 in which a floating gate unit is mounted on the outer end of said slide body unit and depends adjacent the outer end of said outer screed section.

3. A screed extension unit comprising:

a slide rail unit adapted to be mounted on a paving machine with a primary screed and having an inner end and an outer end;

a slide body unit slidably mounted on the slide rail unit for selectively extending outwardly beyond the outer end of the slide rail unit and beyond one end of said primary screed;

an extension screed having an inner screed section mounted at the bottom of said slide body unit and having an outer screed section pivotally mounted at the outer end of the inner screed section for vertical swinging movement in an arc between a lower position aligned with said inner screed section and a raised position sloping upwardly away from said inner screed section;

slope adjusting means extending between said outer screed section and said slide body unit for selectively swinging said outer screed section in said arc; and elevating means connected to said slide rail unit for selectively raising and lowering the slide rail unit to responsively raise and lower said slide body unit and extension screed.

4. A screed extension unit according to claim 3 in which tilting means is connected to said elevating means for selectively tilting said elevating means such that said outer end of the slide rail unit is tilted downwardly, thereby selectively tilting this outer end of said extension screed downwardly.

5. A screed extension unit according to claim 3 in which vibratory mass is mounted on said slide body unit for vibrating said extension screed.

6. An improved screed assembly for a paving machine comprising:

a moldboard having a primary screed at its lower end;

a screed extension slide-mounted on said moldboard and having an outer screed section and an inner screed section, and means for selectively tilting said outer screed section upwardly relative to said inner screed section and primary screed for shaping a sloping berm when said outer screed section completely extends beyond said primary screed and said inner screed section is at the same operating level as said primary screed.

7. A screed unit comprising:

an inner screed section and an outer screed section, each having a flat screed portion and a moldboard portion; and hinge means on said screed unit connecting said screed sections together in end-to-end relation for swinging the outer screed section upwardly in an arc from an aligned position in which the screed portions and moldboard portions of said screed sections are aligned and in which adjacent ends of said screed portions are substantially in contact with one another, the center of said arc being substantially at the contact between said screed portions to keep said screed portions substantially in end-to-end contact while the screed portion swings said arc, and the adjacent ends of said moldboard portions sloping away from said adjacent ends of said screed portions to permit said screed sections to swing in said arc, said hinge means including a central hinge member rigidly mounted on one of said screed portions and having a projecting portion projecting over the other screed portion, said central hinge member having curved convex outer end faces, each having the same center of curvature, said center of curvature being located between said adjacent ends of the screed portions, and said hinge means including a complementing hinge unit rigidly mounted on said other screed portion, said complementing hinge unit providing outer hinge portions with opposed curved concave faces engaging and complementing in shape said convex outer end faces of the central hinge member.

8. A screed unit according to claim 7 in which said outer hinge portions are rigidly connected between side plates which straddle said central hinge member.

9. A screed unit according to claim 7 in which the underside of said projecting portion slopes upwardly away from said other screed portion.

10. A screed unit according to claim 7 in which a cover member is secured to one of said screed sections and is arranged to overlap said moldboard portions.

11. A screed unit comprising:

two screed sections in end-to-end relation having bottom sole surfaces meeting at a hinge axis and having beveled meeting ends separating from said hinge axis; and a hinge unit connected to said screed sections and adapted to operate through a swing angle maintaining said hinge axis, said hinge unit having a central hinge member with arcuate end faces each having said hinge axis as the center of curvature, said central hinge member being anchored to a first of said screed sections and overlapping the other of said screed sections in spaced relation thereto; and said hinge unit having an outer hinge member providing arcuate slide faces complementing and engaging said arcuate end faces, said outer hinge member being anchored to said other screed section and overlapping said first screed section in spaced relation thereto.

* * * * *